United States Patent [19]

Laukien

[11] Patent Number: 4,615,292

[45] Date of Patent: Oct. 7, 1986

[54] SUBMERSIBLE TWIN-HULL WATERCRAFT

[76] Inventor: Gunther R. Laukien, 7512 Rheinstetten-Forchheim, Silberstreifen, Fed. Rep. of Germany

[21] Appl. No.: 610,274

[22] Filed: May 14, 1984

Related U.S. Application Data

[63] Continuation of Ser. No. 264,413, May 18, 1981, abandoned, which is a continuation of Ser. No. 022,630, Mar. 21, 1979, abandoned.

[30] Foreign Application Priority Data

Mar. 23, 1978 [DE] Fed. Rep. of Germany ..... 2812758

[51] Int. Cl.[4] ..... B63H 8/00

[52] U.S. Cl. ..... 114/312; 114/61; 114/333

[58] Field of Search ..... 114/312, 313, 314, 321, 114/333, 335, 339, 61

[56] References Cited

U.S. PATENT DOCUMENTS

| | | | |
|---|---|---|---|
| 1,127,707 | 2/1915 | Whitney | 114/333 |
| 1,300,524 | 4/1919 | Waddington | 114/312 |
| 1,757,174 | 5/1930 | Douglas | 114/61 |
| 1,814,642 | 7/1931 | Spear | 114/312 |
| 3,356,055 | 12/1967 | Link | 114/335 X |
| 3,492,962 | 2/1970 | Brainard | 114/333 X |
| 3,613,615 | 10/1971 | Sturm et al. | 114/16 |
| 3,754,380 | 8/1973 | McMinn et al. | 55/164 |
| 3,848,558 | 11/1974 | Henry | 114/313 |
| 3,937,171 | 2/1976 | Seaborn | 114/61 X |
| 3,996,870 | 12/1976 | Haavie | 114/66 |

FOREIGN PATENT DOCUMENTS

| | | | |
|---|---|---|---|
| 2356537 | 5/1975 | Fed. Rep. of Germany . | |
| 861201 | 10/1940 | France . | |
| 2098989 | 2/1972 | France . | |
| 41617 | 10/1965 | German Democratic Rep. | 114/61 |
| 598988 | 5/1978 | Switzerland . | |
| 823441 | 11/1959 | United Kingdom . | |
| 899185 | 6/1962 | United Kingdom . | |
| 1217163 | 12/1970 | United Kingdom . | |
| 1221871 | 2/1971 | United Kingdom . | |
| 1271859 | 4/1972 | United Kingdom . | |

*Primary Examiner*—George E. A. Halvosa
*Attorney, Agent, or Firm*—Pennie & Edmonds

[57] ABSTRACT

A submersible watercraft has two hulls constructed as submarines disposed generally parallel to and spaced apart from each other. A submersible pilot's cab is disposed generally above the two hulls approximately in a longitudinal symmetry plane defined between the hulls. The two hulls and the pilot's cab are rigidly interconnected by tubular struts.

25 Claims, 4 Drawing Figures

SUBMERSIBLE TWIN-HULL WATERCRAFT

This is a continuation, of application Ser. No. 264,413, filed May 18, 1981, now abandoned, which in turn is a continuation of application Ser. No. 22,630, filed Mar. 21, 1979, now abandoned.

TECHNICAL FIELD

The present invention relates to submersible watercraft; in particular, to a submersible watercraft having two hulls disposed generally parallel to and spaced apart from each other. A pilot's cab having a pressure vessel with viewing ports and a steering stand for the watercraft is disposed generally above the hulls approximately in a longitudinal symmetry plane. The two hulls and the pilot's cab are rigidly interconnected by tubular struts. The two hulls contain propulsion and control mechanisms and are adapted to accommodate between them a submersible craft, a diver work chamber, pipeline repair gear or other operating equipment.

BACKGROUND ART

Experience with oil and natural-gas exploration, production and transmission in the North Sea has shown that, because of the frequent bad weather, surface vessels can be deployed in such work only on a limited scale. The time spent coming and going from and to the nearest port to avoid storms represents a major loss of working time for surface vessels engaged in the North Sea project.

Underwater craft suited for undersea work usually are relatively small and can be employed only in conjunction with a mother ship on the surface. When the mother ship has to leave the area because of impending bad weather, it is forced to take the dependent submersible craft along, even though the submersible craft would in principal avoid the heavy sea conditions by submerging below a relatively shallow depth.

Submersible craft with a surface buoy serving as power-supply unit are similarly affected by bad weather.

German Offenlegungsschrift 23 56 537 of the present inventor discloses a catamaran surface vessel having a submersible gondola located between the two hulls of the catamaran. The catamaran remains afloat when the gondola is lowered for underwater travel. The submersible gondola has a torpedo-like shape widely used for self-propelled underwater craft because of its low resistance to motion for the volume of water displaced, relative to other shapes. Although the catamaran, by virtue of the form stability provided by its two spaced-apart hulls, has a high resistance to capsizing, it is nonetheless susceptible to bad weather and rough seas as are other surface vessels.

U.S. Pat. No. 1,757,174 to Douglas discloses a seagoing vessel having five pontoons: a cabin pontoon, two waterline pontoons, and two power pontoons. The two waterline pontoons are disposed below and to either side of the cabin pontoon. A power pontoon is disposed below each waterline pontoon. The vessel of U.S. Pat. No. 1,757,174 is a surface vessel. Only the power pontoons, located beneath the waterline pontoons, are submerged when the vessel is under way. Consequently, the vessel is also affected by heavy seas.

DISCLOSURE OF THE INVENTION

The present invention has as its object to provide a watercraft which may be employed as floating and submersible operating equipment which may be deployed under a wide variety of weather conditions. Moreover, it is intended to be suited for use as a supply and communications base for a fully or partly autonomous submersible craft up to great depths.

Broadly, the watercraft of the present invention includes a first submersible hull and a second submersible hull disposed generally parallel to and spaced apart from one another. The two submersible hulls are constructed in the manner of submarines, having watertight pressure housings and ballast tanks which may be flooded and blown. The submersible hulls also include propulsion units for motive power and steering mechanisms for control of the craft. The watercraft further includes a submersible pilot's cab disposed generally above the hulls approximately in a longitudinal symmetry plane defined between the two hulls. The pilot's cab includes a watertight pressure vessel and can function as a buoyancy body in that its weight is less than the weight of water it displaces by the pressure vessel when submerged. The pilot's cab has pressure-resistant view ports and contains a steering stand to permit a pilot to maneuver the craft. The watercraft further includes tubular struts rigidly interconnecting the first hull, the second hull, and the pilot's cab. The tubular struts have at least sections which are constructed as pressure-resistant bodies which have a net buoyancy, in that the weight of such a section is less than the weight of volume of water it displaces when submerged.

A feature of the watercraft of the present invention is that when surfaced it has the seaworthy qualities of a catamaran. Moreover, the watercraft is weight stable both in a completely submerged condition and in a partially submerged condition, when the pilot's cab is completely or partly above the mean waterline. A partially submerged condition can be achieved by not flooding the ballast tanks completely or by flooding only a fraction of the tanks. Consequently, the craft can be used and is operational both as a form-stable surface-bound catamaran and as a weight-stable submersible craft or semisubmersible craft.

The watercraft in accordance with the invention is well suited both for subsea work to be performed or supervised from the surface and for subsea work to be performed or supervised from a fully or partly submerged position.

In the surfaced condition; in other words, as a surface craft; it is particularly suited for fair-weather use. The craft then displays the high stability of form of a catamaran.

When the water becomes rougher, some of the ballast tanks of the hulls can be flooded so that the two hulls are substantially completely below the surface, but with the pilot's cab above the water surface. Work can be carried out in this semisubmerged condition so long as the difference in height between wave crests and troughs is not greater than the edge-to-edge spacing between the hulls and the pilot's cab, because the change in buoyancy due to submergence to different depths of the connecting members and of the pressure-resistant buoyancy bodies is small relative to the mass of the hulls. This is why the attitude of the craft will be quite stable even in a moderately rough sea, whereas a surface-bound catamaran in the same sea would be listing a great deal.

In a still heavier sea, such as is encountered even in the North Sea on not more than about 10 to 20% of the days of the year, the craft thereby can submerge completely, thereby avoiding bad weather without having to return to port.

Thus the watercraft in accordance with the invention is ideally suited for use as a working platform in fair weather and as a base vessel for a small submersible craft in any kind of weather. A special advantage is that a small submersible craft can be picked up safely by the watercraft even in a heavy sea, or a storm, because the picking up can be accomplished at a depth sufficient to avoid the effects of the turbulance on the surface. With prior-art systems, picking up a submersible craft is ordinarily possible only in a relatively calm sea.

Moreover, when appropriately outfitted, the watercraft in accordance with the invention can be deployed directly, for example, as a working craft to perform underwater work such as repair and welding operations on drilling islands and subsea pipelines, for jetting pipelines in and out, as an exploration and salvage unit, as an underwater base for a submersible vessel designed for greater depths, for soil-mechanics measurements, and for drilling work. Thus the watercraft in accordance with the invention lends itself not only to all-weather use but has broad uses in virtually any kind of underwater work.

In addition, a preferred watercraft of the invention, in contrast to many special-purpose underwater apparatuses, is a relatively high-speed craft, both when submerged and when surfaced, because its hulls are naturally streamlined and the pilot's cab pressure vessel and the connecting members are also preferably faired. A slight motive power inefficiency when submerged occasioned by the use of two hulls and a pilot's cab relative to that of a single optimally streamlined submarine of equal net displacement is more than offset by the stability and usefulness of the configuration of present invention floating on the surface of the sea and resting on the sea floor.

Thus, a further advantage in subsea operations is that the craft rests firmly on the floor with its two hulls and leaves a sheltered working space between them. The craft can therefore be positioned to straddle a line on which work is to be done.

One or both of the hulls of the watercraft may be equipped with a pressure chamber with egress to the outside for divers. In preferred embodiments of the invention the pilot's cab pressure vessel comprises, in addition to a pilot's compartment, which is preferably maintained under atmospheric pressure by a first pressure controller, a diver exit chamber adapted to be placed under ambient pressure by a second pressure controller. This diver exit chamber is provided with at least one diver exit, disposed on the underside and closable by a hatch. Locating a diver exit chamber in the pilot's cab pressure vessel disposed above the two hulls has the advantage that divers have at all times free access to the diver exit chamber that is unimpeded by projecting seabed obstructions or the like. In addition to or in place of the diver-exit chamber provided in the pilot's cab pressure vessel, a second diver exit may disposed in one of the struts connecting one of the hulls with the upper pressure vessel. The diver exit chamber then is preferably provided with at least one diver exit shaft disposed on the underside and closable by a hatch.

In preferred embodiments of the invention, a hoist is accommodated in the diver exit chamber and a shaft with closable hatches is disposed below the hoist. In a particularly preferred embodiment, however, there is disposed between the diver-exit chamber and the pilot's compartment a third compartment with a closable hatch which can be placed under ambient pressure by a suitable pressure controller and in which a hoist and/or lines for a working medium (electric current, compressed gas or a pressurized liquid) can be accomodated. If desired, this third compartment may be adapted to be connected through pressure-resistant doors with the diver exit chamber and/or the pilot's compartment. By separating the diver hatch and the hoist hatch, the danger that divers may get with their supply lines caught in work lines or in the hoist is minimized. The pressure resistant doors can provide access to the diver exit chamber or the pilot's compartment. This will prove advantageous when a repair is to be made in the third compartment while the watercraft is submerged and the repair is not to be carried out by divers because their time is too expensive. The third compartment then can also serve as an air lock permitting passage from the pilot's compartment to the diver exit chamber or vice versa in the submerged condition. In addition, the third compartment may be made accessible from one hull or from both hulls through a strut. This makes the watercraft in accordance with the invention very versatile in use and provides a high level of safety in the event of unforeseen incidents, since appropriate action may be taken both by divers and by personel remaining under atmospheric pressure.

In a preferred embodiment of the invention, at least one propulsion unit is rigidly or pivotably mounted on the pilot's cab pressure vessel for improved maneuverability of the craft. This propulsion unit can be supplied through the connecting members between the hulls and the pilot's cab pressure body.

In preferred embodiments of the invention, at least one of the members connecting each hull with the pilot's cab pressure vessel is constructed as an enterable passageway in the form of a strut. At least one of these passageways leads to the pilot's compartment, and at least one of the remaining passageways leads to the diver exit chamber or to the third compartment of the pilot's cab pressure vessel. The number of connecting members between the hulls and the pilot's cab pressure vessel may be selected at will on the basis of the strength requirements of the overall structure. Preferably two tubular connecting members (three if there are three compartments) are provided between each hull and the pilot's cab, and additional buoyancy bodies, which may be faired, are disposed in the space between the connecting members or struts. The buoyancy bodies are compartmentalized in respect of their horizontal cross-sectional areas to prevent the water from sloshing back and forth when the bodies are partly flooded. These buoyancy bodies will increase the stability of the craft in surfacing and submerging. The passageways provide great versatility in the uses of the craft since all compartments of the pilot's cab pressure vessel communicate with the hulls through enterable passageways.

The difference in height between the hulls and the pilot's cab is preferably equal to the difference in height between wave crest and wave trough in average sea conditions in the area where the craft is to be deployed. This spacing determines the range over which the craft in accordance with the invention can be deployed as a semisubmersible when the pilot's cab pressure vessel still is completely or partly above the average waterline, since satisfactory operating behavior is secured when the hulls are still submerged in the wave trough while the pilot's cab pressure vessel still is not completely submerged in the wave crest. The edge-to-edge spacing between the hulls and the pilot's cab pressure vessel, may range from 5 to 6 m, for example. This will permit the craft to be used on about 70 to 90% of the days under the unfavorable weather conditions prevailing in the North Sea.

In a preferred embodiment of the invention, at least one of the two hulls contains a supply of compressed gas for blowing ballast tanks for supplying divers and decompression chambers, and for the diver exit chamber. An electric motor serving as a power supply when the craft is submerged is preferably housed in the engine room accommodating the internal-combustion engine. The electric batteries required to power the motor are carried as ballast in the bilge area of the two hulls. In other embodiments of the invention, the batteries are disposed as ballast beneath the hulls in separate pressure vessels parallel to the hulls. Carrying the batteries in the bilge area or in separate pressure vessels, helps to improve the weight stability of the craft.

Moreover, at least one of the connecting members or struts between one of the hulls and the pilot's cab pressure vessel is provided with a closable exit which in surface operation may also serve as an air intake or as egress to the deck.

In preferred embodiments of the invention, the hulls are constructed in the manner of autonomous craft and are provided with pressure-resistant viewports in the work areas.

To broaden the uses of the craft in accordance with the invention still further, there is mounted on each of the two hulls, in accordance with a preferred embodiment, half of a swinging bridge which serves as a working bridge and, if desired, as carrier for a smaller submersible craft, especially when the craft is in the surfaced condition. To increase the stability, the two halves of the swinging bridge can be joined together, and in addition fixed or removable connecting struts can be provided between the hulls to reduce stresses in the area between the struts and the pilot's cab pressure vessel.

BRIEF DESCRIPTION OF THE DRAWINGS

Further details and variants of the present invention will become apparent from the following description, in conjunction with the claims, of an embodiment illustrated in the simplified, diagrammatic drawing, where

BEST MODE FOR CARRYING OUT THE INVENTION

Figure 1:
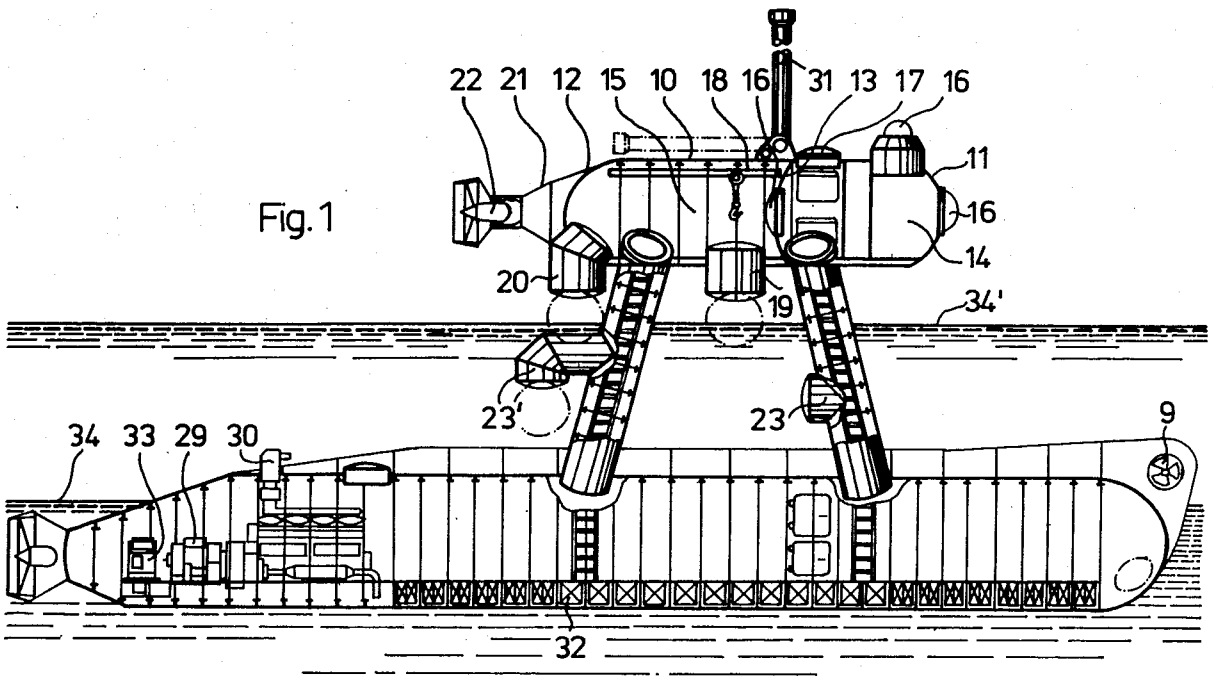
FIG. 1 shows, partly in side elevation and partly in section, a twin-hull watercraft with a pilot's cab disposed above the hulls.
Figure 2:
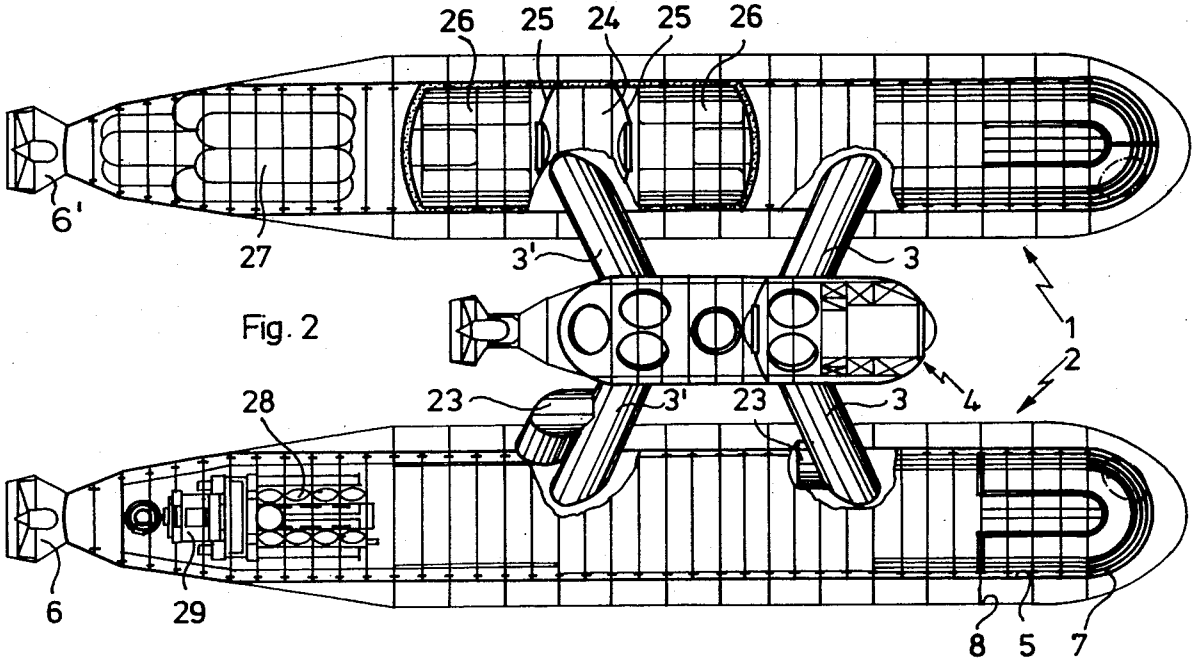
FIG. 2 is a top plan view of the craft according to FIG. 1.

The watercraft shown has a first hull 1 and a second hull 2, each of which is rigidly connected to a pilot's cab 4, disposed above the two hulls 1 and 2, by means of two struts 3 and 3' which are inclined towards a vertical longitudinal symmetry plane defined between the two hulls and also inclined towards a vertical transverse plane passing through the hulls and which approach each other toward the top. The two hulls 1 and 2 have outwardly the same shape, and each consists of an elongated, essentially cylindrical hull pressure vessel 5 whose after end tapers to a propulsion unit 6 and whose forward end is formed by a generally hemispherical section 7. The hulls 1 and 2 are constructed as submarines. The hull pressure vessel 5 is surrounded by a fairing 8 which determines the outer shape of the hulls 1 and 2 and which at the bow end, near the deck, is provided with a side thruster 9. The struts 3 are constructed as pressure-resistant tubes which are joined at one end to a hull pressure vessel 5 and at the other end to the pilot's cab, 4, the joints at both ends being watertight. The pilot's cab 4 has a pressure vessel comprising a cylindrical, elongate body 10 whose ends are provided with forward and aft hemispherical sections 11 and 12, respectively. Approximately at its center the elongate body 10 is partitioned by a dished, pressure resistant bulkhead 13 into a diver-exit chamber 15 and a control and work room 14 serving as a pilot's compartment. Passage from the pilot's compartment 14 to the diver-exit chamber 15 and vice versa is possible through a closable hatch provided in the bulkhead 13.

The arrangement is such that the two forward struts 3 terminate in the pilot's compartment 14, and the two after struts 3' in the diver exit chamber 15. The elongate body 10 is provided in the area of the pilot's compartment 14 with viewports 16 and with an exit hatch 17. The pilot's compartment 14 contains a steering stand (not shown) for piloting the vessel. In the diver exit chamber 15 a hoist 18 is disposed whereby loads may be hauled in or or lowered through a tubular, vertical utility shaft 19 which terminates in the floor of the diver exit chamber 15 and is closable at both ends by means of hatches. A fairing 21 at whose end is mounted a propulsion unit 22 with a propeller adjoins the after end of the pressure body 10.

The struts 3 and 3' are provided with the tube stubs 23 and 23' respectively disposed approximately radially to their longitudinal extension, and closable by means of hatches. Passage from the pilot's cab pressure vessel 4 to the hulls 1 and 2 and vice versa is possible through the struts 3 and 3', which are constructed as passageways. The forward struts 3 terminate in areas of the hull pressure vessel 5 which are under atmospheric pressure, while at least a first of the aft struts 3' does not terminate in a corresponding compartment, it being closed off by a pressure-resistant hatch. Built onto one of the struts 3' is a diver exit 23'. The relatively small compartment 24, which is bounded by two pressure-resistant bulkheads 25, adjoins at both ends a decompression chamber 26.

Compressed-gas tanks 27 are accommodated in an after area of the hull 1, while an internal-combustion engine 28 driving an electric generator which supplies the craft with power is housed, in a space closed off by bulkheads, in an after area of the hull 2. In addition to or in place of the electric generator 29, a hydraulic pump may be provided to supply corresponding systems with a working medium. In surface operation, the necessary air for combustion is supplied to the internal-combustion engine through an air intake 30, while in the semisubmerged condition the engine is connected through a line (not shown) to a snorkle 31 disposed at the top of the upper pressure body 4. In place of or in addition to this snorkel, a floating snorkel may be used. In submerged operation, energy from batteries 32 disposed in the bilge area of one hull or both hulls 1 and 2 is used to power a drive motor 33 which drives a suitable hydraulic pump. This hydraulic pump also feeds the propulsion units 6, 6' and 22. Alternatively, electric motors powered directly from the batteries can be used for the propulsion units 6 and 22. Power to the propulsion units 6 and 6' on the first and the second hulls 1 and 2 respectively can be varied independently to turn the vessel in response to control signals from the steering stand. The side thruster 9 assists in controlling the direction of the motion of the watercraft when submerged. In addition to the snorkel, antennas, lights and the like are mounted on the pilot's cab 4.

Figure 3:
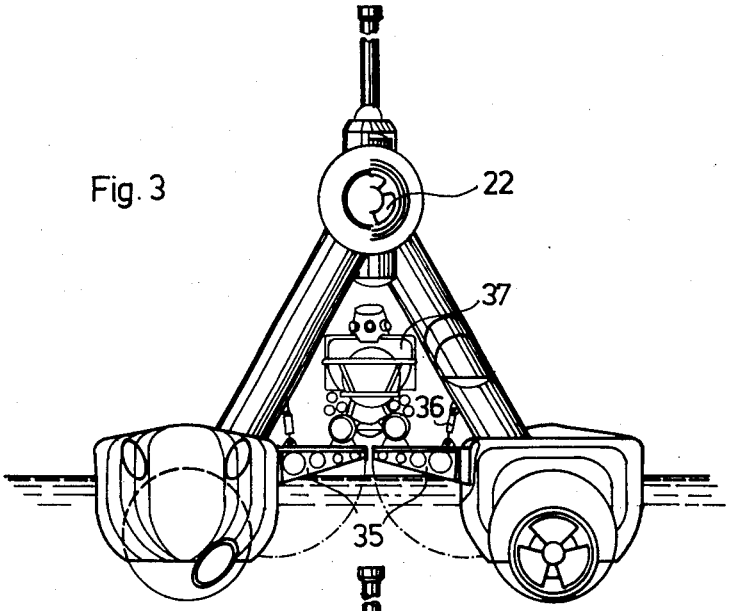
FIG. 3 is a front elevation (left half) and a view of the stern (right half) of the craft according to FIGS. 1 and 2.

FIG. 3 shows the craft in the surfaced condition, one half of the figure being a view of the bow, and the other half a view of the stern, of the craft. Mounted on each of the two hulls 1 and 2 is a half bridge 35, adapted to be swung out of the way by means of actuating members 36. The pivots of the half bridge 35 are inside the fairing 8. In operating position, the half bridges 35 provide work space specifically, they may carry an autonomous or semiautonomous submersible craft of known design. In the surfaced condition, maintenance and service work may readily be performed on the submersible craft 37. When the submersible craft 37 is to leave the base watercraft or is to be picked up by it in a smooth sea, the semisubmerrged operating condition is brought about and the half bridges 35 are swung out of the way, whereupon the submersible craft 37, which may still be suspended from the hoist 18, is lowered. The submersible craft 37 is picked up in revese order, with the base watercraft semisubmerged or, in a choppy sea, submerged.

The watercraft disclosed lends itself particularly well to use as a base vessel for a submersible craft 37 designed for greater depths as it permits the submersible to be deployed largely independently of the weather since the submersible craft 37 can be picked up in the submerged condition, and hence unaffected by surface motion of the sea. However, a submerged base watercraft offers the further advantage of permitting much better communication with the submersible craft 37 located at greater depth since the base watercraft then is located below boundary layers which often adversely affect communications.

Figure 4:
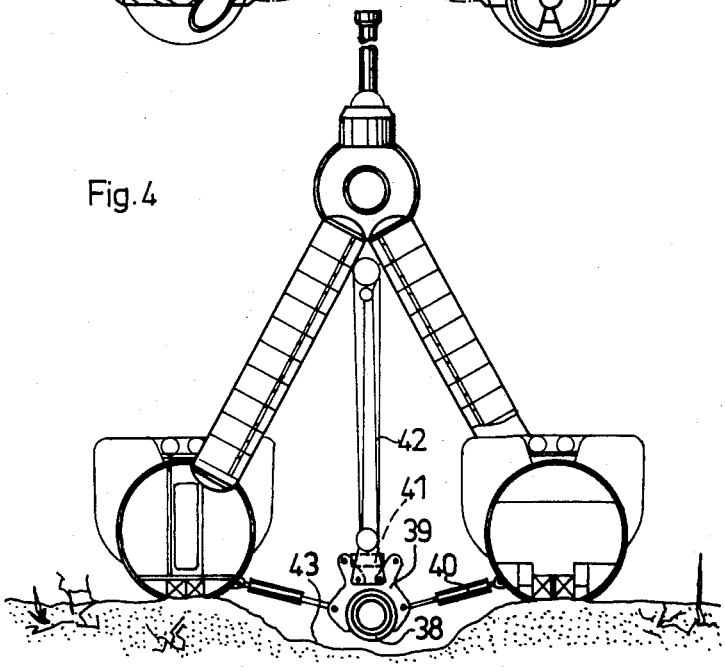
FIG. 4 shows the craft, partly in front elevation and partly in section, in working position on the seafloor.

The underwater watercraft disclosed is suited not only for use as a base craft for a submersible craft, but also for use as an underwater work station, for work on pipelines, for example. To this end, it may be provided, as shown in FIG. 4, with grips 39 for laying or aligning pipe sections 38, said grips being adapted to be operated by actuating members 40 and 41 and to be raised or lowered by a hoist 42. In addition suitable dredge buckets, drills or means for jetting trench 43 may be provided.

As shown in FIGS. 3 and 4, the maximum width of the pilot's cab 4 is less than the minimum distance between the hulls 1 and 2 and the minimum vertical distance between the hulls 1,2 and the pilot's cab 4 is approximately equal to or greater than the minimum distance between the hulls 1,2.

To be able to shift the transition of the craft from the form-stabilized condition (surface operation) to the weight-stablilized condition (submerged operation) into a desired range of the semisubmerged condition, additional buoyancy bodies (not shown) adapted to be flooded and blown are preferably disposed between the struts 3 and surrounded by suitable fairing to reduce to water resistance in the submerged and semisubmerged condition. Struts 3 and 3' are also preferably enclosed by suitable fairing. Such fairing is conventional and need not be described. To increase the mechanical stability, the two hulls 1 and 2 are preferably interconnected by cross struts in the forward and after areas.

The submersible water craft of the present invention is provided with suitable power-supply units and other conventional requisite equipment. The engineering details of such equipment are not necessary for an understanding of the present invention and, for conciseness will not be described.

It is not intended to limit the present invention to the specific embodiments described above. It is recognized that changes may be made in the apparatus specifically described herein without departing from the scope and teachings of the instant invention, and it is intended to encompass all other embodiments, alternatives and modifications consistent with the present invention.

I claim:

1. A submersible watercraft, comprising:

(a) a first hull and a second hull, the two hulls being disposed generally parallel to and spaced apart from each other, the hulls being constructed as submarines and including a propulsion unit and a direction control mechanism for maneuvering the watercraft, each hull having:

(a.1) watertight walls defining a submersible pressure hull, and (a.2) ballast tanks adapted to be flooded and blown for varying the bouyancy of the watercraft;

(b) a submersible pilot's cab spaced apart from the two hulls and disposed generally above the two hulls approximately in a longitudinal symmetry plane defined between the first and the second hulls, the pilot's cab having:

(b.1) a pilot's cab pressure vessel having pressure-resistant viewports and a hatch for admitting a pilot to the interior of the pressure vessel, and (b.2) piloting control means for piloting the watercraft, the pilot's cab weighing less than the volume of water it displaces when submerged, thereby serving as a buoyancy body; and (c) a plurality of tubular members for rigidly interconnecting the pilot's cab and the first and the second hull, each of the tubular members extending between the pilot's cab and a hull so that a catamaran-hull-separation region defined between the two hulls for the length of the watercraft and below the mean water surface when the watercraft is substantially fully surfaced on a substantially even keel is not obstructed by structural members connecting the two hulls, the catamaran-hull-separation region including a below-waterline-hull silhouette area defined in the longitudinal symmetry plane between the first and second hulls, the below-waterline-hull-silhouette area being defined by an upper waterlevel line defined by the intersection of the mean water surface and the longitudinal symmetry plane and by a hull-outline curve defined by the intersection of the longitudinal symmetry plane and lines perpendicular to the longitudinal symmetry plane which are tangent to the first and second hulls at points below the mean water surface when the watercraft is substantially fully surfaced on a substantially even keel, the catamaran-hull-separation region thereby extending from the mean water surface to a depth equal to the depth of a bottom of the hulls when the watercraft is substantially fully surfaced on a substantially even keel, each of the tubular members having at least a section which is pressure resistant and weighs less than the volume of water displaced by the section when it is submerged, so that the watercraft has the stability of a catamaran when substantially fully surfaced and is weight stable when completely submerged and when partially submerged with the two hulls substantially completely below the mean water surface and the pilot's cab above the mean water surface.

2. The submersible watercraft according to claim 1, in which the pilot's cab includes:

(b.3) a first enclosure defining a pilot's compartment, the steering stand being located in the pilot's compartment, (b.4) first pressure controlling means for maintaining the pilot's compartment under approximately atmospheric pressure, (b.5) a second enclosure defining a diver-exit chamber for accommodating a diver, and (b.6) second pressure controlling means for placing the diver-exit chamber under an ambient pressure.

3. The submersible watercraft according to claim 2 in which the second enclosure of the pilot's cab has a diver-exit opening in the enclosure and a tubular diver-exit shaft having a sealable hatch at one end joined to the opening and projecting outward from the pilot's cab providing a passageway for divers to pass between the water and the diver-exit chamber.

4. The submersible watercraft according to claim 3 in which the second enclosure of the pilot's cab has a utility opening in the enclosure and a tubular utility shaft joined to the opening and projecting outward from the pilot's cab for permitting supplies, lines and the like to pass from the diver-exit chamber to the outside of the pilot's cab, the utility shaft having a first sealable hatch and a second sealable hatch mounted respectively at the two ends of the utility shaft.

5. The submersible watercraft according to claim 4 in which the utility opening is located in the floor of the diver-exit chamber and the tubular utility shaft extends linearly in a generally vertical direction when the watercraft is in a horizontal rest position, the watercraft further including a utility hoist located at the diver-exit chamber and cable of being positioned over the utility opening for hoisting articles through the utility shaft.

6. The submersible watercraft according to claim 3 in which the pilot's cab includes a third enclosure defining a third compartment, the third enclosure being located between the diver-exit chamber and the pilot's compartment, the third enclosure having a first opening for access to the third compartment, the first opening having a closable hatch mounted thereon, the pilot's cab further including third pressure-controlling means for maintaining the third compartment under atmospheric pressure.

7. The submersible watercraft according to claim 4 further including a hoist mounted in the third compartment.

8. The submersible watercraft according to claim 4 in which the third enclosure includes a second opening, the first opening providing passage between the third compartment and the pilot's compartment and the second opening provided passage between the third compartment and the diver-exit chamber, the first and the second openings being fitted with pressure-resistant doors.

9. The submersible watercraft according to claim 1 in which a diver-exit hatch is located in one of the tubular members.

10. The submersible watercraft according to claim 1 further comprising an internal-combustion-engine power plant located in one of the hulls.

11. The submersible watercraft according to claim 1, in which the pilot's cab further includes a periscope mounted on the cab for observation during semisubmerged operation.

12. The submersible watercraft according to claim 1 in which the pilot's cab further includes a propulsion unit mounted on the cab.

13. The submersible watercraft according to claim 1 in which at least one of the tubular members serves as a strut and has a passageway extending therethrough.

14. The submersible watercraft according to claim 13 in which the passageway extends between one of the two hulls and the pilot's cab.

15. The submersible watercraft according to claim 13 in which there are at least four tubular members interconnecting the pilot's cab and the first and the second hull, at least two tubular members serving as struts extending between the pilot's cab and the first hull, and at least two tubular members serving as struts extending between the pilot's cab and the second hull.

16. The submersible watercraft according to claim 15 further comprising supplemental buoyancy bodies located between the struts for increased stability in surfacing and submerging.

17. The submersible watercraft according to claim 1 in which the pilot's cab is disposed at least about 5 meters above the two hulls.

18. The submersible watercraft according to claim 1 further comprising a compressed gas supply located in one of the two hulls.

19. The submersible watercraft according to claim 1 further comprising a plurality of electric storage batteries located in bilge areas of the two hulls, the batteries thereby serving as ballast for the two hulls.

20. The submersible watercraft according to claim 1 further comprising a plurality of generally elongated storage pressure vessels adapted to contain electric storage batteries, each storage pressure vessel being attached to one of the two hulls and extending generally parallel to the hull.

21. The submersible watercraft according to claim 1 in which one of the tubular members is provided with a closable exit port.

22. The submersible watercraft according to claim 1 in which one of the hulls further includes a pressure resistant viewpoint for observing a work area.

23. The submersible watercraft according to claim 1 further comprising a swinging bridge located between the two hulls, the swinging bridge comprising a first and a second half-bridge section, the first and the second half-bridge sections being pivotably attached to the first and second hulls to permit the swinging bridge to be swung out of the catamaran-hull-separation region between the two hulls.

24. A submersible watercraft, comprising:

(a) a first hull and a second hull, the two hulls being disposed generally parallel to and spaced apart from each other, the hulls being constructed as submarines, each hull having:

(a.1) watertight walls defining a submersible pressure hull, (a.2) ballast tanks adapted to be flooded and blown for varying the buoyancy of the watercraft, (a.3) a propulsion unit, and (a.4) a direction control mechanism;

(b) a submersible pilot's cab spaced apart from the two hulls and disposed generally above the two hulls approximately in a longitudinal symmetry plane defined between the first and the second hulls, the pilot's cab having:

(b.1) a pilot's cab pressure vessel having pressure-resistant viewports and a hatch for admitting a pilot to the interior of the pressure vessel, (b.2) a first enclosure defining a pilot's compartment, (b.3) piloting control means for piloting the watercraft, the piloting control means being located in the pilot's compartment, (b.4) first pressure controlling means for maintaining the pilot's compartments under approximately atmospheric pressure, (b.5) a second enclosure defining a diver-exit chamber for accommodating a diver, (b.6) second pressure controlling means for placing the diver-exit chamber under an ambient pressure, and (b.7) a propulsion unit mounted on the cab, the pilot's cab weighing less than the volume of water it displaces when submerged, thereby serving as a buoyancy body; and (c) a plurality of tubular members for rigidly interconnecting the pilot's cab and the first and the second hull, each of the tubular members extending between the pilot's cab and hull and having at least a section which is pressure resistant and weighs less than the volume of water displaced by the section when it is submerged, so that the watercraft has the stability of a catamaran when substantially fully surfaced and is weight stable when completely submerged and when partially submerged with the two hulls substantially completely below the mean water surface and the pilot's cab above the mean water surface.

25. A submersible watercraft, comprising:

(a) a first hull and a second hull, the two hulls being disposed generally parallel to and spaced apart from each other, the hulls being constructed as submarines and including a propulsion unit and a direction control mechanism for maneuvering the watercraft, each hull having:

(a.1) watertight walls defining a submersible pressure hull, and (a.2) ballast tanks adapted to be flooded and blown for varying the buoyancy of the watercraft;

(b) a submersible pilot's cab spaced apart from the two hulls and disposed generally above the two hulls approximately in a longitudinal symmetry plane defined between the first and the second hulls, the pilot's cab having:

(b.1) a pilot's cap pressure vessel having pressure-resistant viewports and a hatch for admitting a pilot to the interior of the pressure vessel, and (b.2) piloting control means for piloting the watercraft, the pilot's cab weighing less than the volume of water it displaces when submerged, thereby serving as a buoyancy body; and (c) a plurality of tubular members for rigidly interconnecting the pilot's cab and the first and the second hull, each of the tubular members extending between the pilot's cab and a hull and having at least a section which is pressure resistant and weighs less than the volume of water displaced by the section when it is submerged, the minimum distance between the first and second hulls being greater than the maximum width of the pilot's cab, and the minimum vertical distance between the hulls and the pilot's cab being approximately equal to or greater than the minimum distance between the hulls, so that the watercraft has the stability of a catamaran when substantially fully surfaced and is weight stable when completely submerged and when partially submerged with the two hulls substantially completely below the mean water surface and the pilot's cab above the mean water surface.

* * * * *